United States Patent [19]

Kallianos et al.

[11] Patent Number: 4,696,314

[45] Date of Patent: Sep. 29, 1987

[54] FILTER CIGARETTE

[75] Inventors: Andrew G. Kallianos, Midlothian, Va.; Christopher N. Kounnas, Durham, N.C.

[73] Assignee: Philip Morris Incorporated, New York, N.Y.

[21] Appl. No.: 853,157

[22] Filed: Apr. 17, 1986

[51] Int. Cl.[4] ..... A24D 3/04

[52] U.S. Cl. ..... 131/336; 131/361

[58] Field of Search ..... 131/361, 331, 339, 340, 131/336

[56] References Cited

U.S. PATENT DOCUMENTS

| | | |
|---|---|---|
| 864,307 | 8/1907 | Jones . |
| 2,206,165 | 7/1940 | Daymude . |
| 2,223,302 | 11/1940 | Germain . |
| 2,693,193 | 11/1954 | Pelletier . |
| 2,705,013 | 3/1955 | Brothers . |
| 2,823,680 | 2/1958 | Busby . |
| 2,923,647 | 2/1960 | Aghnides . |
| 2,936,763 | 5/1960 | Saffir . |
| 2,951,486 | 9/1960 | Walters . |
| 3,065,756 | 11/1962 | Davies . |
| 3,409,019 | 11/1968 | Chun . |
| 3,486,508 | 12/1969 | Sipos . |
| 3,503,406 | 3/1970 | Riegel et al. . |
| 3,512,537 | 5/1970 | Pelletier . |
| 3,858,587 | 1/1975 | Cavelli et al. . |
| 3,908,704 | 9/1975 | Clement et al. . |
| 4,480,649 | 11/1984 | Hayes . |
| 4,492,240 | 1/1985 | Hayes et al. . |
| 4,526,183 | 7/1985 | Nichols et al. . |

FOREIGN PATENT DOCUMENTS

| | | |
|---|---|---|
| 0105682 | 4/1984 | European Pat. Off. . |
| 1409656 | 7/1965 | France . |
| 8543374 | 3/1985 | Japan . |
| 7900269 | 5/1979 | PCT Int'l Appl. . |
| 11989 | 6/1904 | United Kingdom . |
| 256432 | 8/1926 | United Kingdom . |

*Primary Examiner*—V. Millinor

*Attorney, Agent, or Firm*—Jeffrey H. Ingerman

[57] ABSTRACT

A cigarette is provided having a variable shape, including variable length and a bendable longitudinal axis. A flexible corrugated tubing section connects a filter plug to a cigarette rod and provides both the variability of the length and the bendability of the cigarette. The variable shape mechanism can be made to additionally provide variable dilution and variable flavorant.

37 Claims, 8 Drawing Figures

FIG. 1
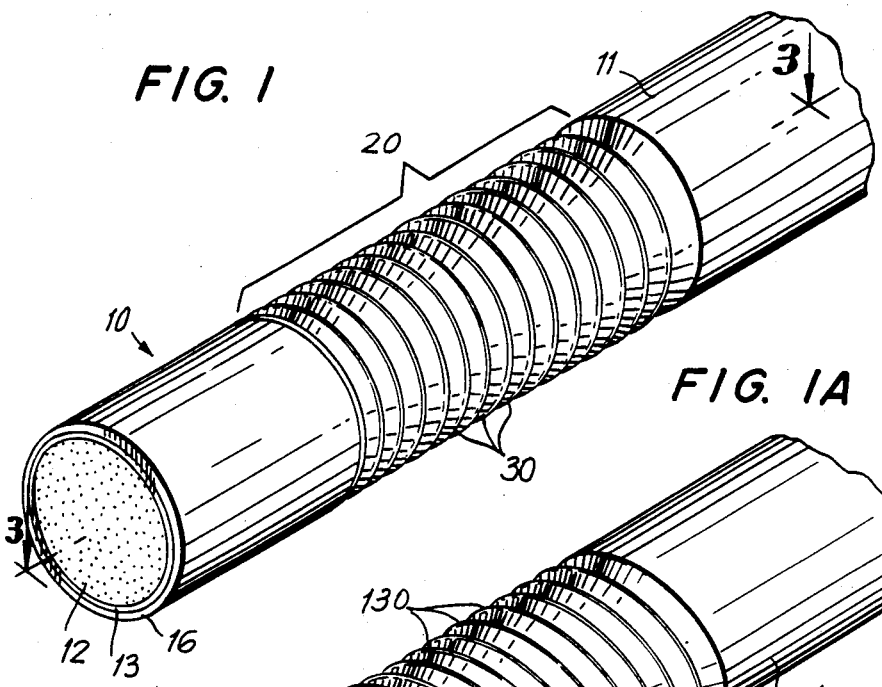
FIG. 1A
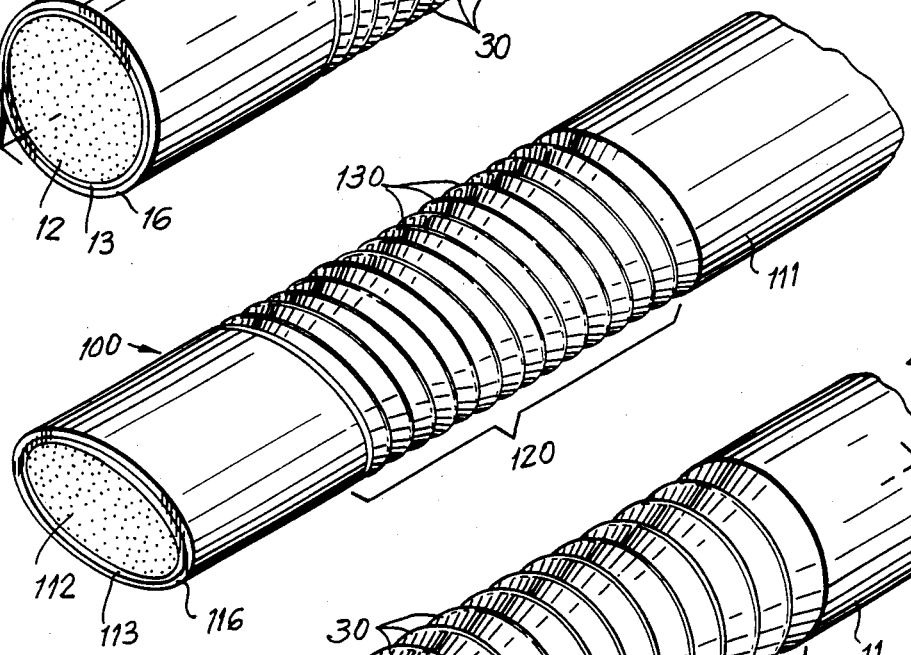
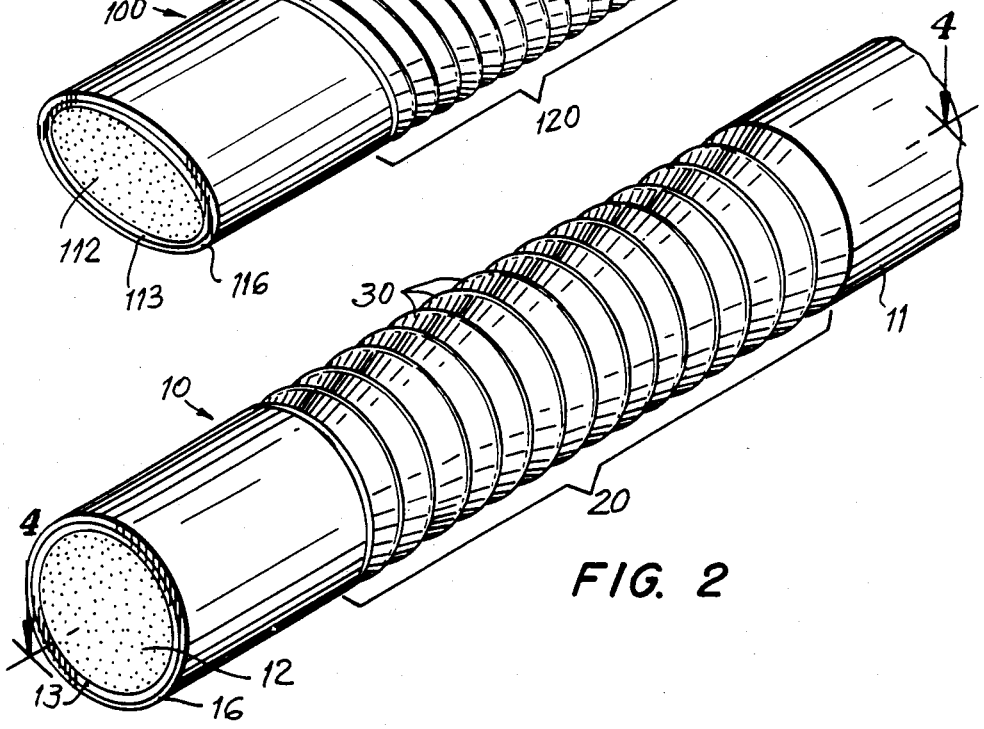
FIG. 2

FIG. 3
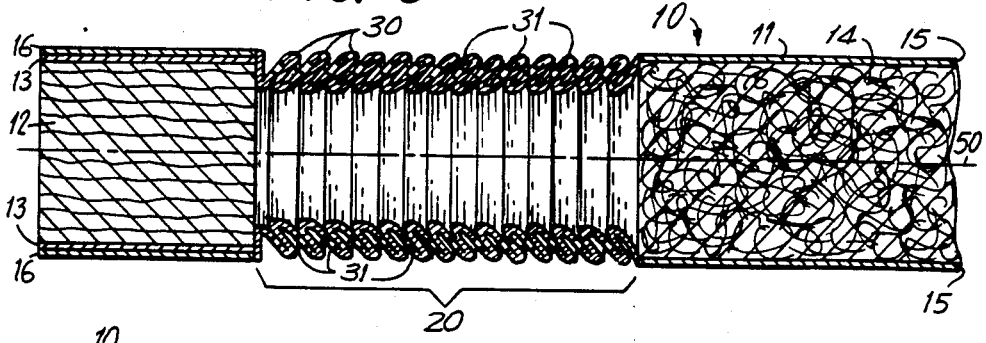
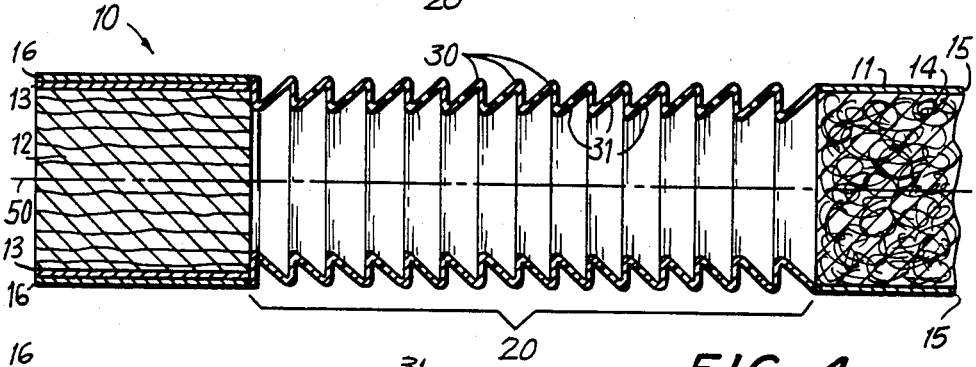
FIG. 4
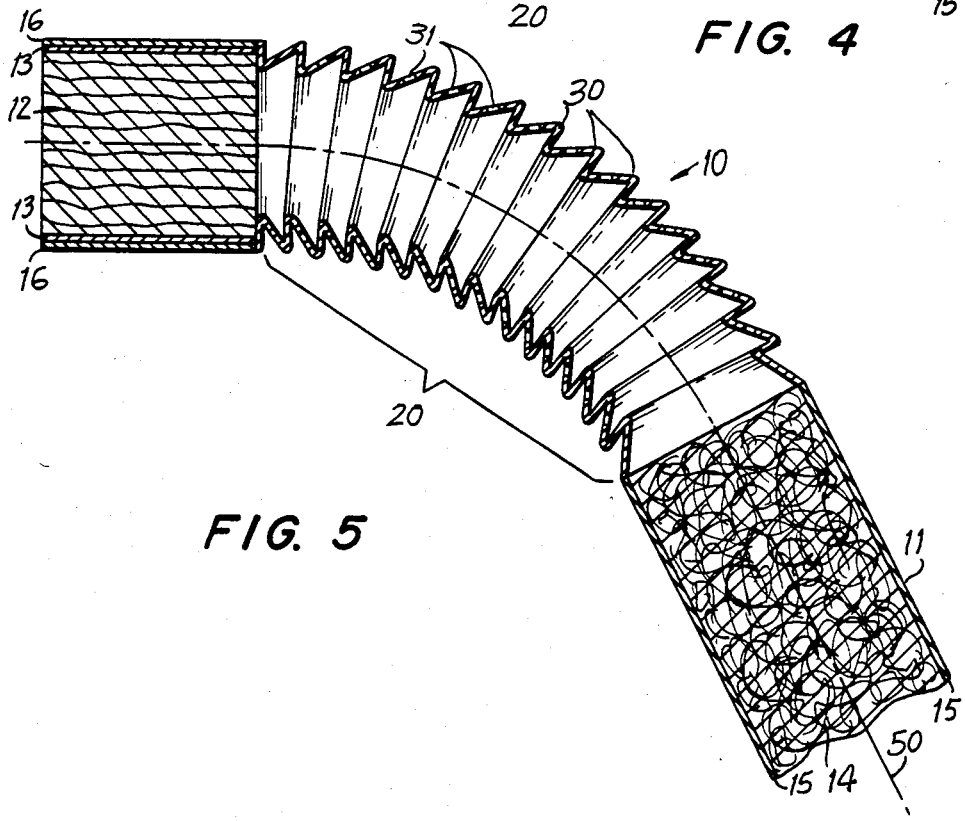
FIG. 5

FILTER CIGARETTE

BACKGROUND OF THE INVENTION

This invention relates to filter cigarettes. More particularly, this invention relates to a filter cigarette having an adjustable shape.

Cigarettes are normally sold in 85 mm and 100 mm lengths. However, some smokers may prefer other lengths. One study, in fact, has shown that many smokers would prefer a cigarette having a length of 90 mm. It is likely that smokers actually have preferences for a range of lengths depending on individual taste. Some smokers may prefer different lengths in different circumstances.

It is well known that a cigarette can be smoked through a holder. A smoker desiring a different length cigarette can obtain a holder of the desired length with which to smoke cigarettes. However, it is not always convenient to have to carry a holder in addition to one's cigarettes. There is no cigarette available whose length can be varied by means of integral elements that cannot be removed.

A smoker may also desire, for novelty or amusement purposes, to smoke a cigarette having a bend in its longitudinal axis. There have not heretofore been any cigarettes available capable of bending, although there is at least one known bendable holder.

It is also desirable for the smoker to be able to vary some smoking characteristics of a cigarette, such as its air dilution value and its flavor. It is known to provide cigarettes having integral rotatable elements which, when rotated, vary the registry of openings in the cigarette tipping paper and plug wrapping to vary air dilution, or which rupture capsules containing flavorant materials, such as menthol or other materials. However, these known cigarettes do not also provide for changing the length of the cigarette or bending its longitudinal axis, which may collectively be referred to as varying the shape of the cigarette.

Further, known cigarettes having variable smoking characteristics have been provided with visual indicators as to the degree to which a variable property has been selected. However, none are provided with tactile and audible indicators which would allow the smoker to select a desired setting without having to look at the cigarette.

SUMMARY OF THE INVENTION

It is an obJect of this invention to provide a cigarette the shape of which can be changed by means of integral elements that cannot be removed. It is another object of this invention that these integral elements be able to function as a mouthpiece.

It is a further object of this invention that the extendable element provide the smoker with the ability to control the smoking characteristics of the cigarette.

It is another object of this invention to provide tactile and audible indications of the degree of adjustment of the cigarette shape and the smoking characteristics.

In accordance with this invention, there is provided a filter cigarette comprising a substantially cylindrical cigarette rod and a substantially cylindrical wrapped and tipped filter plug having a mouth end and a rod end open to the passage of air and smoke, the cigarette rod and the filter plug having substantially the same cross-sectional area and shape. A section of flexible corrugated tubing has a first end affixed to the filter plug and a second end affixed to the cigarette rod, whereby the shape of the filter cigarette can be changed.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 1 is a partially fragmentary perspective view of a filter cigarette according to this invention in its shortened state;

FIG. 1A is a partially fragmentary perspective view of a filter cigarette according to this invention having an ovoid cross section;

FIG. 2 is a partially fragmentary perspective view of the cigarette of FIG. 1 in its lengthened state;

FIG. 3 is a longitudinal cross-sectional view of the cigarette of FIG. 1, taken from line 3—3 of FIG. 1;

FIG. 4 is a longitudinal cross-sectional view of the cigarette of FIG. 2, taken from line 4—4 of FIG. 2;

FIG. 5 is a longitudinal cross-sectional view of the cigarette of FIGS. 1 and 2–4 with a bend in its longitudinal axis;

DETAILED DESCRIPTION OF THE INVENTION

Figure 6:
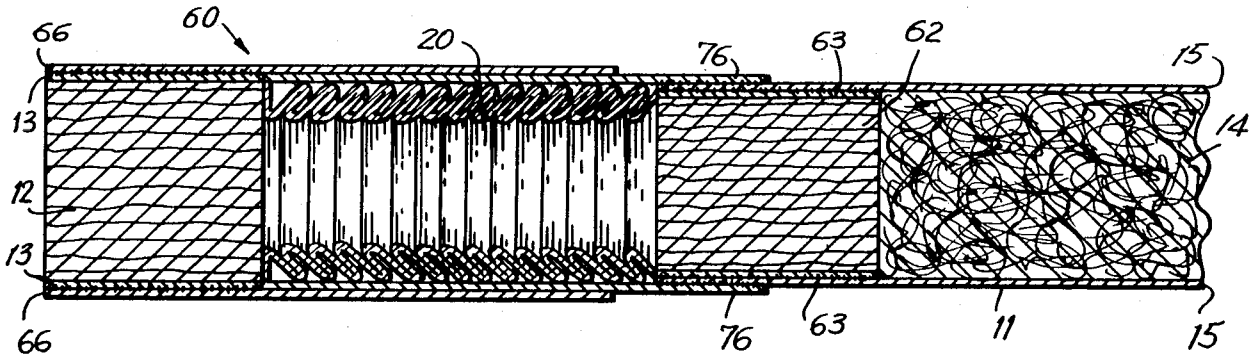
FIG. 6 is a longitudinal cross-sectional view of a second embodiment of a filter cigarette according to this invention in its shortened state.

A first embodiment 10 of a cigarette according to this invention is shown in FIGS. 1 and 2–5. Cigarette 10 includes a cigarette rod 11 and a filter plug 12 wrapped in plug wrapping 13. As shown, cigarette rod 11 is simply a tobacco rod, including a charge of tobacco 14 wrapped in cigarette paper 15. However, cigarette rod 11 could include an additional filter segment (not shown) at the end adjacent filter plug 12, so that cigarette 10 as a whole includes a tobacco rod and a segmented filter plug. Wrapped filter plug 12 is in turn circumscribed by tipping paper 16.

Between cigarette rod 11 and filter plug 12 is a flexible corrugated tubing section 20 having a first end affixed to filter plug 12 and a second end affixed to cigarette rod 11. Flexible corrugated section 20 is capable of expanding and contracting to change the shape of cigarette 10. As shown in FIGS. 1 and 3, section 20 is in its contracted state, and cigarette 10 is therefore in its shortened state. In FIGS. 2 and 4, section 20 is in its maximum expanded state, and cigarette 10 is therefore in its maximum lengthened state. A number of lengths between the shortened state and the maximum lengthened state is possible, depending on the number of corrugations. As shown in FIG. 5, section 20 is also capable of allowing bending of the longitudinal axis 50 of cigarette 10. The change in length of cigarette 10 and the bending of longitudinal axis 50 may be referred to generally as changes in the shape of cigarette 10.

Section 20 can be made of any flexible material, such as paper, but is preferably made from a stiffer material such as paperboard or plastic. A stiffer material such as plastic, and possibly paperboard, will have sufficient "memory" to provide detents as section 20 is expanded and contracted. The detents are caused by the folding and unfolding of corrugations 30. These detents enable section 20 to be adjusted to any one of a number of discrete lengths and to remain at that length until intentionally changed. The detents also provide a tactile and audible indication of the degree of lengthening or shortening of cigarette rod 11, because each corrugation 30 clicks as it folds or unfolds. Corrugated plastic tubing suitable for use in this invention is shown, for example, in U.S. Pat. No. 3,908,704.

The first and second ends of section 20 can be attached to cigarette rod 11 and filter plug 12 by adhesive. Alternatively, cylindrical sleeves (not shown) can extend from first and second ends of section 20 and the filter plug and cigarette rod inserted and attached in them.

Although, as shown in FIGS. 1 and 2–5, cigarette 10 has a circular cross section, cigarettes having non-circular cross sections are also within the scope of this invention. FIG. 1A shows a cigarette 100 according to the invention having an ovoid cross section. Cigarette 100 has an ovoid filter plug 112 circumscribed by plug wrapping 113 and overwrapped by tipping paper 116. Flexible corrugated ovoid tubing section 120 having corrugations 130 connects filter plug 112 to ovoid cigarette rod 111. Other non-circular cross sections are also within the scope of this invention.

Figure 7:
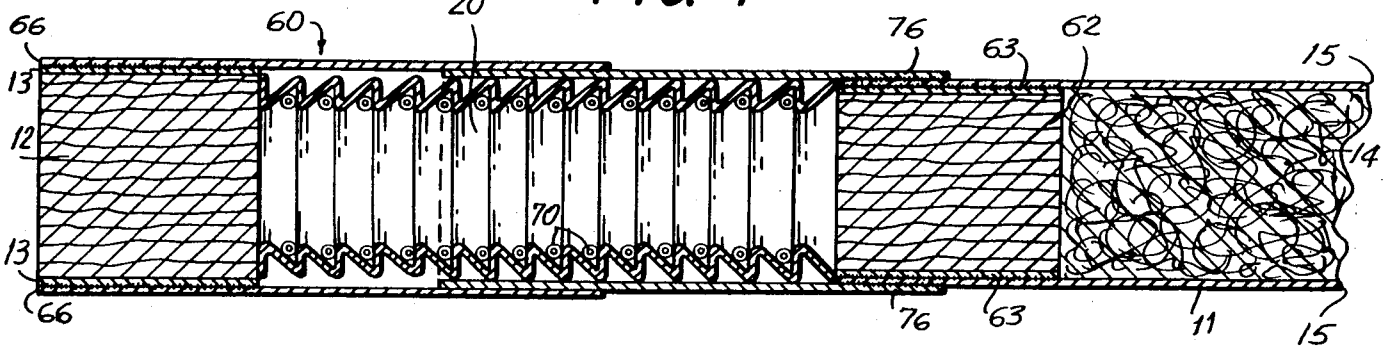
FIG. 7 is a longitudinal cross-sectional view of the cigarette of FIG. 6 in its lengthened state.

A second embodiment 60 of a cigarette according to this invention is shown in FIGS. 6 and 7. Cigarette 60, like cigarette 10, has a cigarette rod 61 connected by a flexible corrugated tubing section 20 to a filter plug 12 wrapped in plug wrapping 23. Here, cigarette rod 61 is shown as including a tobacco rod—i.e., a charge 14 of tobacco wrapped in cigarette paper 15, and an additional filter segment 62 wrapped in plug wrapping 63, so that cigarette 60 includes, in effect, a tobacco rod and a segmented filter plug. However, cigarette rod 61 could also be simply a tobacco rod.

The major difference between cigarette 60 and cigarette 10 is that while section 20 of cigarette 10 is exposed, section 20 of cigarette 60 is covered. First tipping paper section 66 extends from filter plug 62 over section 20 and second tipping paper section 76 extends from cigarette rod 61 over section 20. Although section 66 is shown overlapping section 76, section 76 could also overlap section 66. Sections 66 and 76 are made long enough that they overlap even when section 20 is extended to its maximum length, but not so long that they interfere with each other when section 20 is contracted to its minimum length. Alternatively, section 76 can be eliminated and section 66 can be made so long that it covers section 20 even when section 20 is extended to its maximum length. However, in any embodiment in which section 20 is covered, the cigarette cannot be bent because the covering tipping paper sections will tear.

In addition to providing variable shape, this invention can also provide variable dilution and variable flavorant.

One mechanism for variable dilution according to this invention is shown in FIGS. 3 and 4. Section 20 is made of a substantially air-impermeable material. Perforations 31 are provided in corrugations 30 in such a way that when section 20 is contracted, as shown in FIG. 3, each corrugation 30 is folded over perforation 31 of an adjacent corrugation 30, substantially preventing the admission of air into perforations 30. When section 20 is extended, as shown in FIG. 4, none of perforations 31 is blocked and a maximum amount of air is admitted through perforations 31 into cigarette 10. When section 20 is adjusted to an intermediate length, so that some of perforations 31 are covered and some are open, an intermediate level of dilution is provided. Thus, there are a number of discrete levels of air dilution equal to the number of perforated corrugations 30. Although not shown, variable dilution can be provided in the same way in cigarette 60 as long as at least one of tipping paper sections 66, 76 is air-permeable.

Variable dilution can also be provided by having perforations in tipping paper sections 66, 76 which register to different degrees as cigarette 60 is lengthened or shortened. At least one of tipping paper sections 66, 76 would have to be substantially air-impermeable and tubing section 20 would have to be air-permeable. In embodiments where tipping paper section 76 is omitted, the perforations can be made in tipping paper section 66 and the underlying portions of cigarette rod 11.

One mechanism for variable flavorant according to this invention is shown in FIG. 7. Cigarette 60 can be sold with section 20 in its extended state and with crushable capsules 70 containing flavorant in the folds of some or all of corrugations 30. As section 20 is shortened, capsules 70 burst, releasing their flavorant. Capsules 70 can have shells of paraffin, polyvinyl alcohol, or a mixture of vinyl acetate and algin. The fill can be any flavor in a carrier such as coconut or peppermint oil. The capsule diameter can vary from about 800 microns to about 2,600 microns, and the break force can vary from about 60 grams to about 600 grams.

If larger, more easily broken capsules are used, it is likely that all will be burst after section 20 is once contracted to its shortened state. However, if microcapsules are used, they may be able to survive several contraction and extension cycles before all of them burst, so that the cigarette shape could be changed several times, with additional flavorant being released each time.

In an alternative mechanism for variable flavorant (not shown), a flavorant could be mixed with a carrier that will release it on contact with hot water vapor or other smoke constituents. The mixture would then be coated onto the internal surfaces of corrugations 30. If the cigarette is sold with section 20 in its contracted state, the corrugations 30 are not exposed to the smoke flow, but as section 20 is extended, an increasing amount of the mixture will be exposed to the smoke flow, increasing flavorant delivery. If the cigarette is sold with section 20 in its extended state, it will start with maximum flavorant delivery, which can be decreased by shortening section 20.

Many different flavorants can be used. Flavorants which can be added to the smoke during the course of smoking the entire cigarette, such as menthol, can be used. Alternatively, flavorants which would be overwhelming if added during the course of smoking the entire cigarette, but which could be refreshing as a "last puff freshener" if added during the last few puffs, such as anise or orange, could be used. If a "last puff freshener" is used, the smoker would be instructed not to change the shape of the cigarette until he was almost ready to finish it.

Thus, a cigarette is provided having a variable shape which can also be provided with variable dilution and variable flavorant. One skilled in the art will appreciate that the present invention can be practiced by other than the described embodiments, which are presented for purposes of illustration and not of limitation, and the present invention is limited only by the claims which follow.

What is claimed is:

1. A filter cigarette comprising:

a substantially cylindrical cigarette rod;

a substantially cylindrical filter plug having a mouth end and a rod end open to the passage of air and smoke, the cigarette rod and the filter plug having substantially the same cross-sectional area and shape;

plug wrapping circumscribing said filter plug;

tipping paper circumscribing said wrapped filter plug;

a section of flexible corrugated tubing having a first end affixed to said filter plug and a second end affixed to said cigarette rod, whereby the shape of said filter cigarette can be changed; and means for varying the air dilution value of said filter cigarette responsive to the change of shape of said filter cigarette.

2. The filter cigarette of claim 1 wherein said change in shape includes a change in the length of said filter cigarette.

3. The filter cigarette of claim 1 wherein said change in shape includes a bend in the longitudinal axis of said filter cigarette.

4. The filter cigarette of claim 1 wherein the cigarette rod and the wrapped filter plug have a circular cross section.

5. The filter cigarette of claim 1 wherein the cigarette rod and the wrapped filter plug have an ovoid cross section and the cross sections are in registry.

6. The filter cigarette of claim 1 wherein said section of flexible corrugated tubing is made of a material which is sufficiently stiff to provide defined incremental changes of the shape of said cigarette.

7. The filter cigarette of claim 6 wherein said material is sufficiently stiff to provide tactile indication of said incremental changes.

8. The filter cigarette of claim 6 wherein said material is sufficiently stiff to provide audible indication of said incremental changes.

9. The filter cigarette of claim 6 wherein said material is plastic.

10. The filter cigarette of claim 1 wherein said section of flexible corrugated tubing is substantially air-impermeable and has a plurality of corrugations, said corrugations being folded upon one another when said flexible corrugated section is in a contracted state, at least some of said corrugations having openings therein, said openings being closed to the passage of air when said corrugations are folded and open to the passage of air when said corrugations are unfolded, an increasing number of said corrugations being unfolded as said flexible corrugated section is expanded from said contracted state, whereby varying amounts of air are admitted to said filter cigarette as said flexible corrugated section is expanded and contracted to change the shape of said cigarette.

11. The filter cigarette of claim 1 wherein said cigarette rod is a tobacco rod.

12. The filter cigarette of claim 1 wherein said cigarette rod comprises a tobacco rod and a filter segment at an end of said tobacco rod adjacent said filter plug.

13. A filter cigarette comprising:

a substantially cylindrical cigarette rod;

a substantially cylindrical filter plug having a mouth end and a rod end open to the passage of air and smoke, the cigarette rod and the filter plug having substantially the same cross-sectional area and shape;

plug wrapping circumscribing said filter plug;

tipping paper circumscribing said wrapped filter plug;

a section of flexible corrugated tubing having a first end affixed to said filter plug and a second end affixed to said cigarette rod, whereby the shape of said filter cigarette can be changed; and flavorant means associated with said filter plug and adapted to release varying amounts of flavorant responsive to the change of shape of said filter cigarette.

14. The filter cigarette of claim 13 wherein said section of flexible corrugated tubing has a plurality of corrugations, said corrugations being folded upon one another when said flexible corrugated section is in a contracted state, an increasing number of said corrugations being unfolded as said flexible corrugated section is expanded from said contracted state, said flavorant means comprising flavorant generating means associated with at least some of said plurality of corrugations for releasing flavorant when said shape of said filter cigarette is changed.

15. The filter cigarette of claim 14 wherein said flavorant generating means comprises a coating of a flavorant material mixed in a carrier substance, said carrier substance being such as to release said flavorant material when said mixture is exposed to the smoke stream of said filter cigarette, said coating being coated inside at least some of said corrugations, whereby said flavorant material is released into said smoke stream in increasing amounts as said flexible corrugated portion is expanded and in decreasing amounts as said flexible corrugated section is contracted.

16. The filter cigarette of claim 14 wherein said flavorant generating means comprises flavorant capsules placed in said corrugations in said expanded state, whereby flavorant is released into the smoke stream of said filter cigarette as said flexible corrugated section is contracted and said capsules rupture.

17. The filter cigarette of claim 13 wherein said change in shape includes a change in the length of said filter cigarette.

18. The filter cigarette of claim 13 wherein said change in shape includes a bend in the longitudinal axis of said filter cigarette.

19. The filter cigarette of claim 13 wherein the cigarette rod and the wrapped filter plug have a circular cross section.

20. The filter cigarette of claim 13 wherein the cigarette rod and the wrapped filter plug have an ovoid cross section and the cross sections are in registry.

21. The filter cigarette of claim 13 wherein said section of flexible corrugated tubing is made of a material which is sufficiently stiff to provide defined incremental changes of the shape of said cigarette.

22. The filter cigarette of claim 21 wherein said material is sufficiently stiff to provide tactile indication of said incremental changes.

23. The filter cigarette of claim 21 wherein said material is sufficiently stiff to provide audible indication of said incremental changes.

24. The filter cigarette of claim 21 wherein said material is plastic.

25. The filter cigarette of claim 13 wherein said cigarette rod is a tobacco rod.

26. The filter cigarette of claim 13 wherein said cigarette rod comprises a tobacco rod and a filter segment at an end of said tobacco rod adjacent said filter plug.

27. A filter cigarette comprising:

a substantially cylindrical cigarette rod;

a substantially cylindrical filter plug having a mouth end and a rod end open to the passage of air and smoke, the cigarette rod and the filter plug having substantially the same cross-sectional area and shape;

plug wrapping circumscribing said filter plug;

tipping paper circumscribing said wrapped filter plug;

a section of flexible corrugated tubing having a first end affixed to said filter plug and a second end affixed to said cigarette rod, whereby the shape of said filter cigarette can be changed; and a first section of tipping paper adhered to said filter plug and extending over said flexible corrugated section and a second section of tipping paper adhered to said cigarette rod and extending over said flexible corrugated section, one of said first and second sections overlapping the other of said first and second sections, whereby said flexible corrugated section is covered from view by said first and second tipping paper sections, said change in shape being a change in length.

28. The filter cigarette of claim 27 wherein said change in shape includes a change in the length of said filter cigarette.

29. The filter cigarette of claim 27 wherein said change in shape includes a bend in the longitudinal axis of said filter cigarette.

30. The filter cigarette of claim 27 wherein the cigarette rod and the wrapped filter plug have a circular cross section.

31. The filter cigarette of claim 27 wherein the cigarette rod and the wrapped filter plug have an ovoid cross section and the cross sections are in registry.

32. The filter cigarette of claim 27 wherein said section of flexible corrugated tubing is made of a material which is sufficiently stiff to provide defined incremental changes of the shape of said cigarette.

33. The filter cigarette of claim 32 wherein said material is sufficiently stiff to provide tactile indication of said incremental changes.

34. The filter cigarette of claim 32 wherein said material is sufficiently stiff to provide audible indication of said incremental changes.

35. The filter cigarette of claim 32 wherein said material is plastic.

36. The filter cigarette of claim 27 wherein said cigarette rod is a tobacco rod.

37. The filter cigarette of claim 27 wherein said cigarette rod comprises a tobacco rod and a filter segment at an end of said tobacco rod adjacent said filter plug.

* * * * *